United States Patent [19]

Fang

[11] Patent Number: 4,718,706

[45] Date of Patent: Jan. 12, 1988

[54] TUBULAR DOOR LOCK WITH AN ADJUSTABLE DEVICE

[75] Inventor: Yau C. Fang, Chiayi, Taiwan

[73] Assignee: Posse Lock Manufacturing Co., Ltd., Hou-Hu Chiayi, Taiwan

[21] Appl. No.: 880,878

[22] Filed: Jul. 1, 1986

[51] Int. Cl.[4] ..... E05C 21/00

[52] U.S. Cl. ..... 292/337; 292/1; 292/169.13

[58] Field of Search ..... 292/337, 1, 169.13

[56] References Cited

U.S. PATENT DOCUMENTS 2,776,155 1/1957 Gerlach ..... 292/337 X
3,300,240 1/1967 Tornoe et al. ..... 292/337
4,496,178 1/1985 Best et al. ..... 292/337 X
4,623,174 11/1986 Trull et al. ..... 292/337 X

*Primary Examiner*—Richard E. Moore
*Attorney, Agent, or Firm*—Holman & Stern

[57] ABSTRACT

This invention relates to a tubular door lock which mainly includes a basic shell, an extending shell, a dead bolt, two assembling plates, a safety bolt, a locking plate and an unlocking plate. Through apertures, notches and holes disposed thereon, it can connect seletively together in a short (60 mm) or long (70 mm) position, and is therefore able to change the distance between the knob and the faceplate of the lock via adjustment of the extending shell.

3 Claims, 8 Drawing Figures

TUBULAR DOOR LOCK WITH AN ADJUSTABLE DEVICE

BACKGROUND OF THE INVENTION

When fixing a tubular door lock in a door, a long latitudinal groove needs to be cut on the side surface of a door so as to fit the lock in, and a turning hole then is cut in the front surface of the door to fit with the intersecting crossed hole of the lock. The "crossed hole" is a rotatable member having a cross-shaped opening.

Usually, locks nowadays manufactured are divided into two sizes—60 mm and 70 mm—representing different distances between its crossed hole and faceplate. Therefore, in order to satisfy different needs, manufacturing two different sizes of locks, retailers are obliged to devote more space for storing them, and buyers, unless having knowledge of locks, may feel at a loss in selecting them.

SUMMARY OF THE INVENTION

In order to solve the problems in the above mentioned art, the present invention has been worked out to provide tubular door locks able to make the distance between its crossed hole and the faceplate adjustable so as to fit with any door it is to be mounted on.

DETAILED DESCRIPTION OF THE INVENTION

Figure 1:
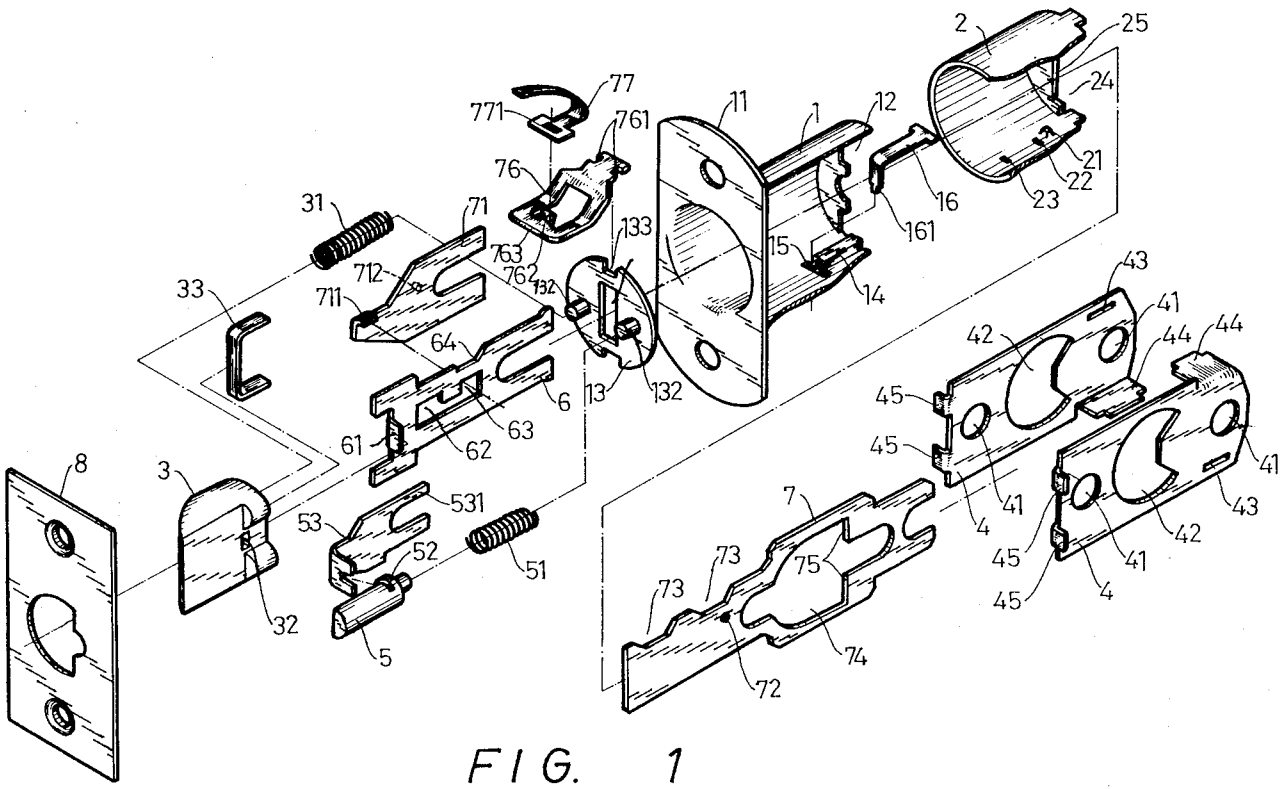
FIG. 1 is an assembly view of the tubular door lock of the present invention.

As shown in the FIG. 1, this invention includes mainly a basic shell 1, an extending shell 2, a dead bolt 3, two assembling plates 4, a safety bolt 5, a locking plate 6 and an unlocking plate 7.

The basic shell 1 consists of a faceplate for containing all the other parts. At the bottom of the basic shell 1, there is an aperture 12 enabling the unlocking device to be able to extend out. The bottom is to be connected with an attaching plate 13.

A slot 14 projected inwards is set at one side of the basic shell 1 and used for guiding a hump 21 of the extending shell 2 to move to and fro along it in a linear motion. In addition, a hole 15 bored in the basic shell 1 and adjacent to the slot 14 is to let a locking tip 161 of a leaf spring 16 extend out.

The attaching plate 13 is pressed to form an aperture 131 same as the aperture 12, so as to let the extending device extend out. Two rods 132 projected on it are to engage respectively with one end of two springs 51, 31 so that the attaching plate 13 can lean against the bottom of the basic shell 1.

The extending shell 2 is to shallow the basic shell 1 and has a hump 21 able to move to and fro along the slot 14 in a linear motion. Two holes 22, 23 cut in the dotted line of the hump 21 can be selectively locked by the locking tip 161. Its bottom is as well cut with an aperture 24 enabling the unlocking device to extend out and has a wall 25 for connecting with the assembling plates 4.

Figure 2:
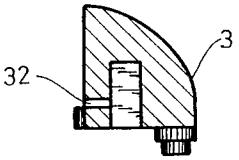
FIG. 2 is the 2—2 sectioned view of FIG. 3.
Figure 3:
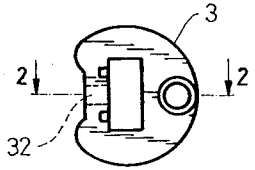
FIG. 3 is a side view of the dead bolt of the present invention.

The dead bolt 3 is the same as the known art. As shown in the FIGS. 2, 3, it has a big aperture for the locking plate 6 to go into it. A projection 61 of the locking plate 6 can extend out from a hole 32 of the dead bolt. After the locking plate 6 and the dead bolt 3 are assembled together, an U-shaped plate 33 is additionally inserted into so as to prevent them from disassembling. The dead bolt 3 has a flat surface for the safety bolt 5 to move along.

The assembling plates 4 are two symmetrical plates which respectively have two holes 41, an aperture 42 for a rotatable plate of a knob to run through, a matching slot 43 and a connecting arm 44. Each matching slot 43 will engage with the opposite connecting arm 44 to keep the two assembling plates 4 connected in place. They have respectively two projected hooks 45 for hooking up the wall 25 of the extending shell 2. The safety bolt 5 is to lean on the plate of the dead bolt 3 and has a groove 52 for locking with a burglar plate 53.

The locking plate 6 has a projection 61 used to lock in the hole 32 of the dead bolt 3 so as to link together, and two locking apertures 62, 63 for a projection 711 of a pulling plate 71 to lock in selectively.

The unlocking plate 7 possesses a hole 72 which is to receive a bolting hump 712 of the pulling plate 71, enabling the pulling plate 71 to rotate declinedly so that the projection 711 of the pulling plate 71 can be adjusted to locate in the locking aperture 62 or 63 of the locking plate 6.

The unlocking plate 7 has two notches 73 which have respectively a narrow bottom and a wide opening. When the unlocking plate 7 is moved, the notches 73 will push up a stopping plate 76. A big aperture 74 in the unlocking plate 7 is adopted to receive the knob and a vertical wall 75 is formed for the motivation of the pulling plate. This is the well-known structure of conventional tubular locks.

The stopping plate 76 possesses two ears 761 for locking in the top notch 133 of the connecting plate 13 and a projection 762 for engaging in a hole 771 of a leaf spring 77. By means of one side of the leaf spring 77 leaning against the interior wall of the basic shell 1 the stopping plate 76 is to be pushed downward enabling its lip 763 to lock downward into the burglar notch 64 and the notches 73 of the unlocking plate 7.

The burglar notch 64 of the locking plate 6, as shown in the figure, has a narrow bottom, a wider opening and one side wall vertical but the other inclined gradually widening upward.

In addition, when all the parts have been fitted inside the basic shell 1, a faceplate 8 is to be covered so that they won't loosen off.

Figure 4:
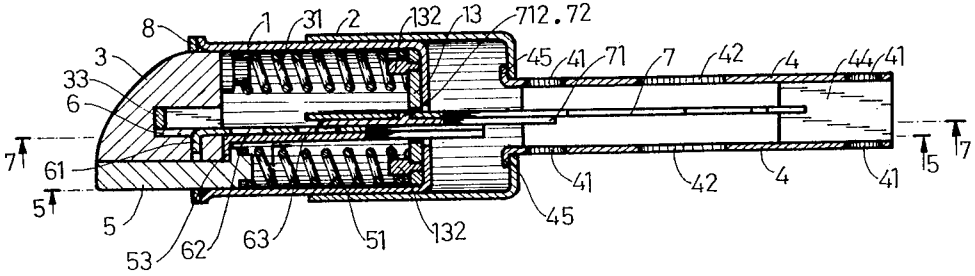
FIG. 4 is the 4—4 sectioned view of FIG. 5.

Next, the FIG. 4 shows a vertically sectioned view of the assembled lock. The unlocking plate 7, the pulling plate 71, the locking plate 6 and the burglar plate 53 are orderly attached closely and all run through the apertures 131, 12 of the connecting plate 13 and the basic shell 1; the locking plate 6 is fixed in the dead bolt by an U-shaped plate; the bolting hump 712 of the pulling plate 71 is received in the hole 72 of the unlocking plate 7 and the projection 711 locked in the aperture 63; inserted between the dead bolt 3 and the connecting plate 13 are two springs 31, 51 which are to retain the dead bolt 3 extending out of the faceplate 8. This is the structure adjusted to the length of 70 mm.

Figure 5:
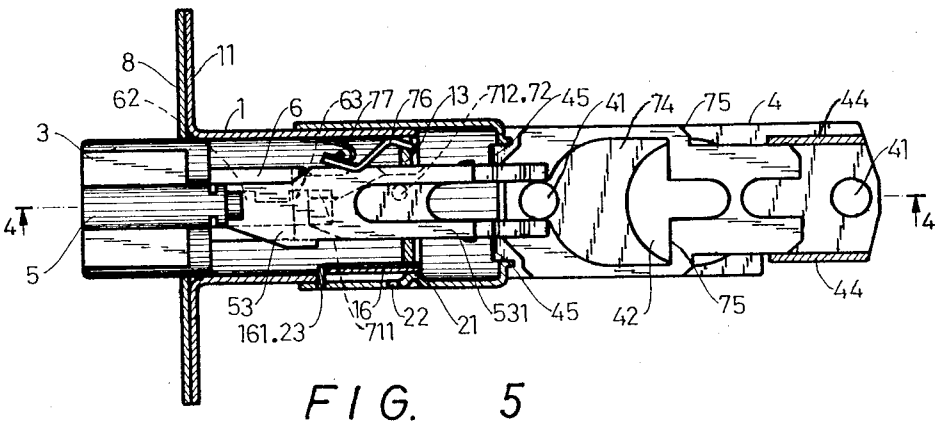
FIG. 5 is the 5—5 sectioned view of FIG. 4.

FIG. 5 is the 5—5 sectioned view of the FIG. 4.

The extending shell 2 is in the state of extention making the tip 161 of the leaf spring 16 penetrate through the hole 15 of the basic shell and locked in the hole 23 of the extending shell 2. Though the stopping plate 76 is pushed up by the leaf spring 77 to make the tip 763 lock in the notches 73 and the burglar notch 64, the lip can not descend stopped by a wall 531 of the burglar plate 53, and thus the burglar notch 64 doesn't work for stopping and the dead bolt 3 is able to be pushed backward, forming a regular action of opening a door. Therefore, when the lock is fixed in a door, the rotation of the knob will motivate to move in order the vertical wall 75 of the unlocking plate 7, the unlocking plate 7, the pulling plate 71, the locking plate 6, the dead bolt 3 and the safety bolt 5, enabling the dead bolt 3 and the safety bolt 5 to move inward.

Figure 6:
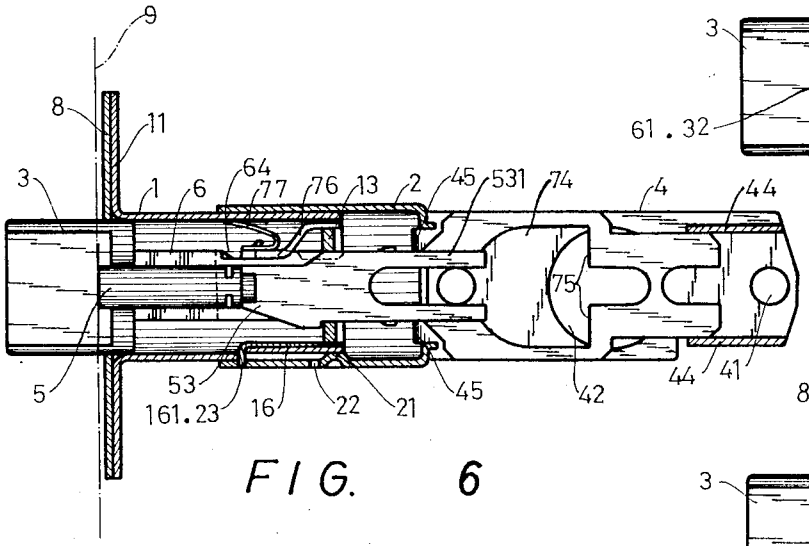
FIG. 6 is the view of the safety bolt moved inward pushed by the door with the structure of FIG. 5.

FIG. 6 shows that the lock is fixed in a door and locks in the door frame. By this moment, the safety bolt 5 is forced by the door frame to back up, and meanwhile the burglar plate 53 is retracted to make the wall 531 of the burglar plate 53 face no more against the notches 73 of the unlocking plate 7 and the burglar notch 64 of the locking plate 6. So the lip 731 of the stopping plate 76 is able to descend into the notches 73 and the burglar notch 64. By then, as the burglar notch 64 is vertically stopped, any illegal force trying to make the dead bolt 3 move back will be stopped, attaining the object of anti-burgular. But if the knob is rotated to motivate the unlocking plate 7 to move back, the unlocking plate 7, by means of the inclined wall of the notches 73, will push up the lip 763 of the stopping plate 76. Thus the locking plate 6 will be backed up as well, making the burglar notch 64 no longer stopped by the stopping plate 76 and enabling the dead bolt 3 to be backed up, forming action of opening a door.

Figure 7:
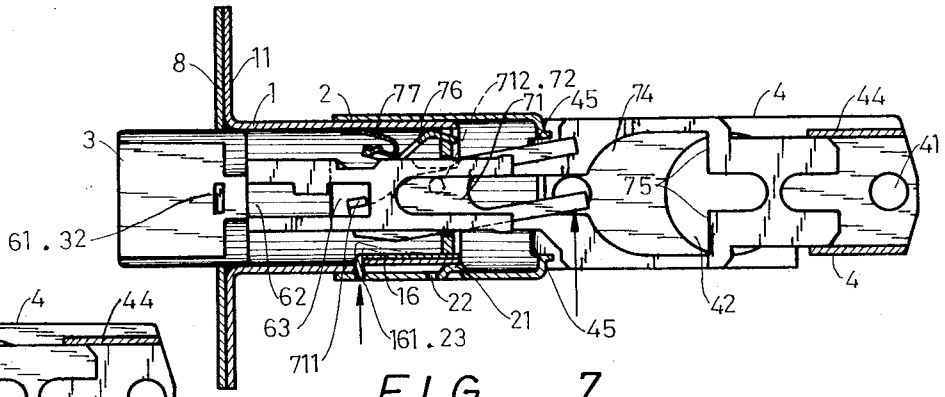
FIG. 7 is the cross-sectioned view of 7—7 of FIG. 4, showing the action of the pulling plate.
Figure 8:
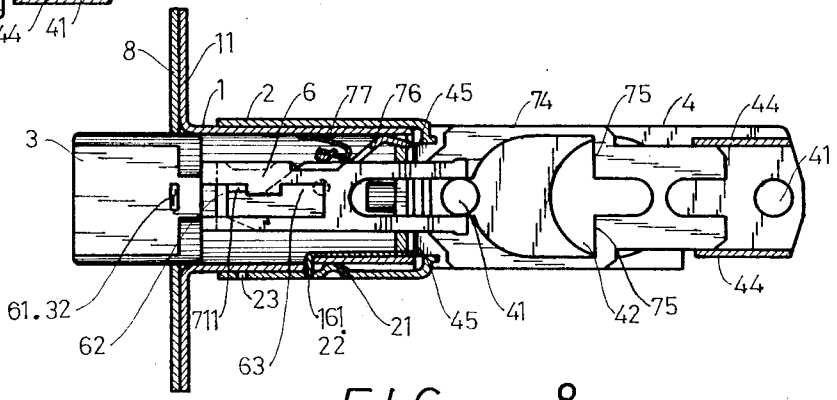
FIG. 8 is the structural view of the present invention adjusted to the short size.

Furthermore, as shown in FIG. 7, when the distance between the dead bolt 3 and the vertical wall 75 of the unlocking plate 7 is expected to be shorter—so called 60 mm—we can insert a sharp object into the locking tip 161 of the leaf spring 16 so as to make it move inward and away from the hole 23 of the extending shell 2, and then a sheet of plate to push upward the pulling plate 71 enabling the pulling plate 71 to rotate around by centering the hump 712 located in the hole 72 of the unlocking plate 7 and the projection 711 of the pulling plate 7 to move off the aperture 63 of the locking plate 6. Next, press the dead bolt 3 and the extending shell 2 to move inward until the projection 711 reaches the bottom of the locking plate 6 and then release the force for pushing the pulling plate 71, and the pulling plate 7 will drop down by nature of gravity or be pressed down by a sheet of plate so that the projection 711 of the pulling plate 7 is as well to lock in the notch 62 of the locking plate 6, forming the short position as shown in FIG. 8.

What is claimed is:

1. A length-adjustable tubular door lock comprising a tubular main shell having a forward open end with a surrounding face-plate and a rear wall with an aperture, a tubular extender shell received on the main shell, the extender shell having an open forward end and an apertured back wall, a pair of elongate assembly plates extending rearwardly from the apertured back wall of the extender shell with a space therebetween, aligned openings in the assembly plates for a rotatable door-knob shaft, an extending and retracting door bolt, a locking plate having a forward end secured to the door bolt, the locking plate being received within the main shell with the bolt extending from said forward open end thereof, biasing means fitted between the rear wall of the main shell and the bolt for projecting the bolt outwardly of said forward end, a pulling plate in the main shell adjacent the locking plate, a projecting tab on the pulling plate, an elongate aperture in the locking plate having a pair of spaced locating formations for selective receipt of the tab therein, an unlocking plate having a forward end portion received in the main shell adjacent the pulling plate and a rearward end portion extending through the apertured back wall of the extender shell between the assembly plates, a pivot connection between the forward end portion of the unlocking plate and the pulling plate, an opening in the rearward end portion of the unlocking plate to receive the door knob shaft so that rotation of the shaft may provide rearward movement of the unlocking plate, the pulling plate and the locking plate to retract the bolt, a two-position detent means connected between the main shell and the extender shell for providing lengthwise movement of the extender shell on the main shell between forward and backward positions effectively adjusting the distance between the face plate and said apertures in the assembly plates, and adjustment means for correspondingly moving the tab on the pulling plate as between the respective locating formations in the locking plate to effectively adjust the distance between said opening in the locking plate and the bolt in conformity with said forward and backward positions of the extender shell, the adjustment means including a back end portion of the pulling plate protruding outwardly from the apertured back wall of the extender shell for engagement by an inserted object to tilt the pulling plate about said pivot connection for engaging and disengaging the tab in the respective locating formations.

2. The invention as defined in claim 1 including a retractable safety bolt juxtaposed with the door bolt, further biasing means urging the safety bolt toward and extended position, a pivoted stopping plate in the main shell having a projection for engaging a notch in the locking plate to prevent the door bolt from being retracted when the safety bolt is in selected position, and movement of the safety bolt being effective to remove said projection from said notch an allow the door bolt to be retracted.

3. The invention as defined in claim 1 wherein the detent means comprises a leaf-spring element extending lengthwise against an internal wall of the main shell, a tab element at one one of the leaf-spring element extending through an opening in the wall of the main shell, and a pair of lengthwise openings in the extender shell to selectively receive the tab element in said forward and backward positions.

* * * * *